US011511506B2

(12) United States Patent
Brand

(10) Patent No.: US 11,511,506 B2
(45) Date of Patent: Nov. 29, 2022

(54) METHOD FOR CONTROLLING THE ROTOR ROTATIONAL SPEED OF A ROTOR OF A ROTARY TABLET PRESS, AS WELL AS A ROTARY TABLET PRESS

(71) Applicant: Fette Compacting GmbH, Schwarzenbek (DE)

(72) Inventor: Alexander Brand, Hamburg (DE)

(73) Assignee: Fette Compacting GmbH, Schwarzenbek (DE)

( * ) Notice: Subject to any disclaimer, the term of this patent is extended or adjusted under 35 U.S.C. 154(b) by 425 days.

(21) Appl. No.: 16/228,902

(22) Filed: Dec. 21, 2018

(65) Prior Publication Data

US 2019/0193362 A1 Jun. 27, 2019

(30) Foreign Application Priority Data

Dec. 21, 2017 (DE) ..... 10 2017 130 885.7

(51) Int. Cl.
*B30B 11/00* (2006.01)
*B30B 11/08* (2006.01)

(52) U.S. Cl.
CPC ..... *B30B 11/005* (2013.01); *B30B 11/08* (2013.01)

(58) Field of Classification Search
CPC ..... B30B 11/005; B30B 11/08; B30B 11/00; B30B 11/10; B30B 15/005; B30B 15/0023; B30B 15/0094; B30B 15/0005; B30B 15/26; B30B 15/148; A61J 3/10
USPC ..... 100/35
See application file for complete search history.

(56) References Cited

U.S. PATENT DOCUMENTS 5,158,728 A * 10/1992 Sanderson ..... A61J 3/10 264/113
7,136,717 B2 11/2006 Noack
8,568,630 B2 10/2013 Herrmann et al.
9,061,394 B2 * 6/2015 Chang ..... B24B 37/013
2003/0086973 A1 * 5/2003 Sowden ..... A23G 3/368 424/474

(Continued)

FOREIGN PATENT DOCUMENTS

CN 101130286 A 2/2008
DE 102012012575 A1 12/2013

(Continued)

OTHER PUBLICATIONS

Machine translation of RU 2165851 C1 (Year: 2001).*

(Continued)

*Primary Examiner* — Shelley M Self
*Assistant Examiner* — Teresa A Guthrie
(74) *Attorney, Agent, or Firm* — Barclay Damon LLP

(57) ABSTRACT

A rotary tablet press comprises a rotor comprising a rotary drive configured to rotate the rotor and a die plate that rotates with the rotor and comprises a plurality of cavities and a plurality of upper and lower punches. A rotational speed governor is configured to drive the rotary drive of the rotor by comparing a measured rotor rotational speed with a target rotational speed value. A pilot control apparatus is configured to provide an additional target torque for driving the rotary drive. The additional target torque is based on values of a pressing force of at least one of the upper and lower punches input into the pilot control apparatus.

13 Claims, 3 Drawing Sheets

(56) References Cited

U.S. PATENT DOCUMENTS

| | | | | |
|---|---|---|---|---|
| 2004/0156940 | A1* | 8/2004 | Noack | B30B 11/005 425/354 |
| 2011/0142978 | A1* | 6/2011 | Linossier | B30B 15/22 425/140 |
| 2011/0318411 | A1* | 12/2011 | Luber | A61K 9/2018 424/464 |
| 2013/0122782 | A1 | 5/2013 | Chang et al. | |

FOREIGN PATENT DOCUMENTS

| | | | | |
|---|---|---|---|---|
| EP | 1445093 | A1 | | 8/2004 |
| EP | 2168761 | A2 | | 3/2010 |
| JP | 199149865 | | | 4/1991 |
| JP | H08-71128 | A | | 3/1996 |
| JP | 2002500701 | A | | 8/2002 |
| JP | 2004106123 | A | * | 4/2004 |
| JP | 2004106123 | A | | 4/2004 |
| JP | 2004243413 | A | | 9/2004 |
| JP | 2014533610 | A | | 12/2014 |
| RU | 2165851 | C1 | | 4/2001 |

OTHER PUBLICATIONS

Indian Patent Application 201824048316; filed Dec. 20, 2018; Indian Office Action dated Sep. 1, 2020 (7 pages).
German Patent Application 10 2017 130 885.7; filed Dec. 21, 2017; Japanese Office Action dated Jun. 23, 2020 (6 pages).
German Patent Application 10 2017 130 885.7; filed Dec. 21, 2017; English translation of Japanese Office Action dated Jun. 23, 2020 (6 pages).

* cited by examiner

METHOD FOR CONTROLLING THE ROTOR ROTATIONAL SPEED OF A ROTOR OF A ROTARY TABLET PRESS, AS WELL AS A ROTARY TABLET PRESS

CROSS REFERENCE TO RELATED INVENTION

This application is based upon and claims priority to, under relevant sections of 35 U.S.C. § 119, German Patent Application No. 10 2017 130 885.7, filed Dec. 21, 2017, the entire contents of which are hereby incorporated by reference.

BACKGROUND

The invention relates to a method for controlling the rotor rotational speed of a rotor of a rotary tablet press, wherein the rotor has a rotary drive for rotating the rotor, a die plate that rotates with the rotor and has a plurality of cavities as well as a plurality of upper and lower punches that also rotate with the rotor and are assigned in pairs to a cavity in the die plate for pressing filling material in the cavity into a pellet, wherein a rotational speed governor drives the rotary drive of the rotor by comparing a measured rotor rotational speed with a target rotational speed value.

The invention moreover relates to a rotary tablet press, comprising a rotor with a rotary drive for rotating the rotor, a die plate that rotates with the rotor and has a plurality of cavities as well as a plurality of upper and lower punches that also rotate with the rotor and are assigned in pairs to a cavity in the die plate for pressing filling material in the cavity into a pellet, moreover comprising a rotational speed governor that is designed to drive the rotary drive of the rotor by comparing a measured rotor rotational speed with a target rotational speed value.

The rotational speed governor reliably offers a constant rotor rotational speed in the standard operating mode of a rotary tablet press at rotor rotational speeds of, for example, more than 60 RPM. In practice, it has been revealed that with low rotational speeds that are desired or necessary due to the process in many applications of rotary tablet presses such as in galenics, uneven rotational speeds occur along with an associated strong shaking, or respectively vibration of the rotary tablet press. In addition to a significant development of noise, this has an undesirable influence on the process results, in particular the produced tablets. Accordingly, the shaking can cause the cavities to be unevenly filled with filling material and hence can cause uneven tablet results.

On the basis of the explained prior art, the object of the invention is therefore to provide a method and a rotary tablet press of the aforementioned type with which constantly reliable operation with consistent processing results without undesirable noise development is possible, even at low rotor rotational speeds.

BRIEF SUMMARY OF THE INVENTION

The invention achieves the object in that an additional target torque for driving the rotary drive is provided as a pilot control based on directly or indirectly determined pressure values of the upper and/or lower punches.

For a rotary tablet press of the aforementioned type, the invention achieves the object in that a pilot control apparatus is also provided that is configured as a pilot control to provide an additional target torque for driving the rotary drive based on directly or indirectly determined pressure values of the upper and/or lower punches.

With a rotary tablet press, the invention is used with a rotor that is rotatably driven by a rotary drive. While rotating, the rotor has a die plate that also rotates with a plurality of cavities in which the filling material which is generally in powdered form is filled to be pressed into a tablet. The cavities can be directly formed by holes in the die plate. They can also be formed, however, by die sleeves that are inserted into the die plate. The die plate can be a single-part ring disc, or it can consist of a plurality of ring segments. The rotor moreover has a plurality of upper and lower punches that also rotate with the rotor. A single pair of an upper punch and lower punch is assigned to each cavity in the die plate and rotates therewith. During operation, the upper and lower punches in the area of the compression station(s) of the rotary tablet press are pressed into the cavities to press the filling material located therein into a tablet. The rotary tablet press can comprise a pre-compression station and a main compression station. In the pre-compression station, the filling material is pre-pressed, and in the main compression station, the filling material is pressed into the finished tablet. For example, in so-called double rotary tablet presses, a plurality of compression stations can also be provided, in particular a plurality of pre-compression stations and a plurality of main compression stations. Each compression station can have upper and lower pressing rollers that press the upper and lower punches into the cavities. This design of a rotary tablet press device is known per se.

A rotational speed governor of the rotary tablet press compares a measured rotational speed, which can be provided to the rotational speed governor for example as an input variable, with a target rotational speed value for the rotor rotational speed which is preset for the rotational speed governor. If the rotational speed governor identifies a deviation in this case, the rotational speed governor drives the rotary drive in order to readjust the measured rotational speed to the target rotational speed value. This rotational speed can be regulated permanently in the method according to the invention, or respectively the rotary tablet press according to the invention, during the operation of the rotary tablet press. The rotational speed can for example be detected by a rotational speed sensor provided on the rotary drive or the rotor. The preset target rotational speed value can depend on various process conditions such as the material to be pressed, the tablet size, or the equipping of the rotary tablet press.

As explained above, high-frequency rotational speed fluctuations and the associated shaking of the rotary tablet press occur in particular at low rotational speeds of, for example, 20 RPM or less. The present invention is based on the insight that, due to the high moment of inertia of the rotor that for example weighs more than 100 kg, the rotational speed governor must only compensate the constant frictional torque of the compression stations, in particular of the pressing rollers pressing the upper and lower punches into the cavities, at higher rotational speeds of the rotary tablet press of e.g. 60 RPM. Accordingly, the kinetic energy of the rotor is sufficient to move the upper and lower punches past the pressing rollers. The rotational speed governor therefore only has to be readjusted slightly at high rotor rotational speeds so that the rotor rotational speed can be easily kept constant. The invention is moreover based on the idea that the rotational energy of the rotor is no longer sufficient to move the upper and lower punches past the pressing rollers at lower rotational speeds of for example 20 RPM or less.

This causes a significant drop in the rotational speed when a pair of upper and lower punches come into contact with a pair of pressing rollers. In order to intervene, the rotational speed governor must first identify a rotational speed error. As a reaction to the strong drop in the rotational speed, the rotational speed governor strongly readjusts in order to readapt the rotor rotational speed to the target rotational speed value. Due to the delay associated therewith, the rotational speed governor provides a significantly higher drive torque for the rotary drive when the pair of upper and lower punches that previously came into contact with the pressing rollers again leaves the contact region with the pressing rollers. Whereas a suddenly increased torque is needed when the upper and lower punches enter the pressing rollers, a correspondingly lower torque is needed upon leaving the pressing rollers. This effect causes the rotor rotational speed to then significantly exceed the target rotational speed value. The rotational speed governor correspondingly readjusts just as strongly in the other direction so that the provided drive torque is again insufficient when the next pair of upper and lower punches enter the pressing rollers. This yields the significant fluctuations in rotational speed observed in practice that can be manifested as a shaking of the rotary tablet press. In an extreme case, the rotor may even come to a standstill at particularly low rotational speeds when a pair of upper and lower punches enters the pair of pressing rollers.

It is accordingly also not useful to increase the control frequency of the rotational speed governor. This has other negative effects on the operation of the rotary tablet press since the rotational speed governor would react with strong torque for the rotary drive in the event of even minute changes in rotational speed. This in turn causes overshooting and correspondingly high stress on the rotary drive and the mechanics of the rotary tablet press.

To solve the explained problem, the invention provides a pilot control based on pressure values of the upper and/or lower punches. In so doing, pressure values of at least one upper punch and/or at least one lower punch, preferably a plurality of upper and/or lower punches, more preferably all upper and/or lower punches, are determined. The pressure values are measured during the pressing process for pressing the filling material in the cavity. The pressure values are therefore determined in particular when the upper and/or lower punches are in contact with pressing rollers of the compression station(s) of the rotary tablet press. The pressure of all the compression stations of the rotary tablet press can be measured. As explained, pre-compression and main compression stations for example can be provided that have pre-pressing rollers and main pressing rollers. Correspondingly, the pressure can then be measured in the pre-compression station (upper and/or lower pre-pressing rollers) and/or in the main compression station (upper and/or lower main pressing rollers). In so doing, it is in principle sufficient to measure pressure at one pressing roller, i.e., at the upper or lower pressing roller. Based on the pressure measurement, the load torque to be anticipated is determined for the rotary drive when passing through the compression stations, in particular the pressing rollers. This load torque to be anticipated is forwarded as a pilot control variable to the rotational drive control in the form of the additional target torque. The rotary drive is thus driven such that it also applies the additional target torque as well as the target torque needed to achieve the target rotational speed.

The invention is based on the idea that the pressing forces arising while pressing tablets in rotary tablet presses are proportional to the torque to be applied by the rotary drive to the rotor. In particular at low rotational speeds when the rotation energy of the rotor is insufficient for the upper and lower punch to press through below the pressing rollers, the then necessary additional torque can be determined in this manner. The invention is also based on the idea of the frictional torque, in particular of the pressing rollers, that arises during a rotation of the rotor being substantially constant. In contrast, a (highly) dynamically alternating torque is variable that is caused by the upper and lower punches that alternately come into contact with the pressing rollers and out of contact with the pressing rollers. At high rotational speeds of the rotor, this dynamically alternating torque is, as explained, compensated by the high rotation energy of the rotor. The rotational speed governor must therefore only compensate the constant frictional torque. Whereas in the invention the rotational speed governor continues to compensate this constant frictional torque in order to thus keep the rotational speed constant, the pilot control according to the invention ensures that the dynamic torque is also reliably and evenly compensated by the pressing processes, even when the rotation energy of the rotor is insufficient for this.

Due to the pilot control according to the invention, the rotational speed does not drop upon initial contact between the upper and lower punches and the pressing rollers, and also does not increase beyond the target rotational speed value when the upper and lower punches leave the pressing rollers. Instead, the load torque to be anticipated in the process is forwarded by the pilot control to the rotary drive as additional target torque such that the rotor rotational speed can also be reliably kept constant at low rotational speeds and high pressing forces. In particular, controlling the rotary drive adapts the necessary torque based on the pilot control before a significant deviation of the measured rotational speed from the target rotational speed value occurs. Accordingly, the explained rotational speed fluctuations and the shaking of the rotary tablet press associated therewith do not occur. It is thereby guaranteed that the relevant quality criteria for the pressing process, such as a defined pressure maintenance time while pressing, are maintained even at low rotational speeds. The press runs evenly and quietly which ensures that the filling of the cavities with filling material is correspondingly reliably constant. Pressing force curves can be adjusted very precisely.

The invention can also be advantageously retrofitted in existing rotary tablet presses. Control can be by a fieldbus. The invention is particularly advantageous in galenics, i.e., in laboratory operation, when for example low rotational speeds may be desired at high pressing forces, for example for test purposes, and constant test parameters are of utmost important.

To determine the additional target torque, the pilot control apparatus and/or the rotational speed governor can access a characteristic map, a table, or calculation instructions. The rotary drive can be driven based on the additional target torque according to a control ramp so that the torque of the rotary drive is increased according to the ramp. Overshooting processes can thereby be avoided.

The pilot control apparatus, or respectively the pilot control can take into account one or more additional parameters such as the position of the pressing force sensors and any phase shift in the measuring signals, the type of pressing force sensors, the type and rated torque of the rotary drive, a rotary speed threshold at which the pilot control is activated, such as less than 30 RPM, preferably less than 20 RPM, the number and size (such as the punch head geometry) of the upper and lower punches, the rotor diameter, the diameter of the partial circle of the cavities, the equipping of the rotary tablet press with upper and lower punches, and the position of the compression stations, in particular the position of the pressing rollers relative to each other.

According to one embodiment, the additional target torque can be determined during at least one entire rotation of the rotor. The pilot control apparatus is then correspondingly configured to determine the additional target torque during at least one entire rotation of the rotor. On this basis, an additional target torque profile (anticipated load profile) can be provided as a pilot control for at least one entire rotation of the rotor. A time-dependent or preferably position-dependent additional target torque curve results for the rotor, or respectively its rotary drive. On this basis, the rotary drive can be driven such that it can compensate in advance the load torque to be anticipated in a rotation according to the entrance and exit of the upper and lower punches into, or respectively out of the pressing rollers. This yields a particularly reliable pilot control. In particular, the method according to the invention with the pilot control according to the invention can be designed to be permanent during the operation of the rotary tablet press, wherein for example as explained above, a rotational speed threshold can be preset, below which the pilot control is used. The rotational speed governor generally works permanently in any case during the operation of the rotary tablet press.

According to a particularly practical embodiment, a frequency converter can drive the rotary drive as the rotational speed governor. The frequency converter can receive the target rotational speed value as a first input variable and the additional target torque as a second input variable, wherein the frequency converter drives the rotary drive based on the target rotational speed value and the additional target torque. In so doing, the frequency converter can determine a target torque from the comparison of the target rotational speed value with the actual rotational speed value of the rotor in order to readjust the rotational speed of the rotor to the target rotational speed. In addition to this target torque value, the additional target torque can also be used by the frequency converter as a basis to drive the rotary drive.

The additional target torque can be provided by a pilot control apparatus which receives pressing force measured values as input variables.

According to another embodiment, the pressing force can be measured by at least one pressing force sensor that is arranged on at least one pressing roller of the rotary tablet press that presses the upper and/or lower punches to press the filling material into the cavities. In this embodiment, pressing force is measured directly. The at least one pressing force sensor can for example be at least one force transducer arranged on the at least one pressing roller of the compression station(s). Such pressing force sensors are generally already provided in rotary tablet presses since the pressing force characteristic is evaluated as an important parameter for quality assurance. Accordingly, no new sensors need to be installed for the invention. Retrofitting in existing presses is particularly easy, for example during a software update. The pressing force measurement by such pressing force sensors is a rotational-angle-related pressing force measurement, i.e., position-dependent. A precise local assignment and hence a particularly reliable pilot control of the rotary drive are possible. In particular, a certain position does not have to be assigned to the time value as for example is the case with a time-resolved pressing force measurement. An error source is thereby eliminated. In particular when the pressing forces are determined for the pressing force curves of each upper and/or lower punch, the pilot control also takes into account any tolerances, or respectively deviations between the punches. Moreover, the pilot control also functions reliably in this manner even when for example individual punch pairs are removed in laboratory operation, i.e., not all punch positions of the rotor are equipped. As explained, the pressing force of all of the upper and/or lower punches can be determined. Moreover, the pressing force at all the compression stations can be evaluated as also already explained. It would also be conceivable to provide the additional target torque for the pilot control based on an average of pressing forces measured for a plurality of punches of the rotary tablet press. It would also be conceivable to provide the additional target torque on the basis of a maximum value of the measured pressing force of a plurality of punches.

According to another embodiment, the pressing force can be measured by determining the torque of the rotary drive. As explained, the torque is proportional to the pressing force. Consequently, the pressing force can be measured indirectly by a measurement of the torque. To determine the torque, the torque can for example be calculated from a pressing force curve.

According to another embodiment, the rotor can be rotated in the method according to the invention at a speed of less than 30 RPM, preferably less than 20 RPM. As already mentioned, a rotational speed threshold can for example be preset below which the pilot control, or respectively the pilot control apparatus according to the invention is active. This rotary speed threshold can have the aforementioned values. As also already mentioned, the pilot control according to the invention is in particular advantageous at low rotational speeds.

The method according to the invention can be carried out by the device according to the invention. Accordingly, the device according to the invention and its components can be designed to perform the method according to the invention and its method steps.

BRIEF DESCRIPTION OF THE DRAWINGS

An exemplary embodiment of the invention is explained in greater detail below with reference to the figures.

DETAILED DESCRIPTION OF THE INVENTION

Figure 1:
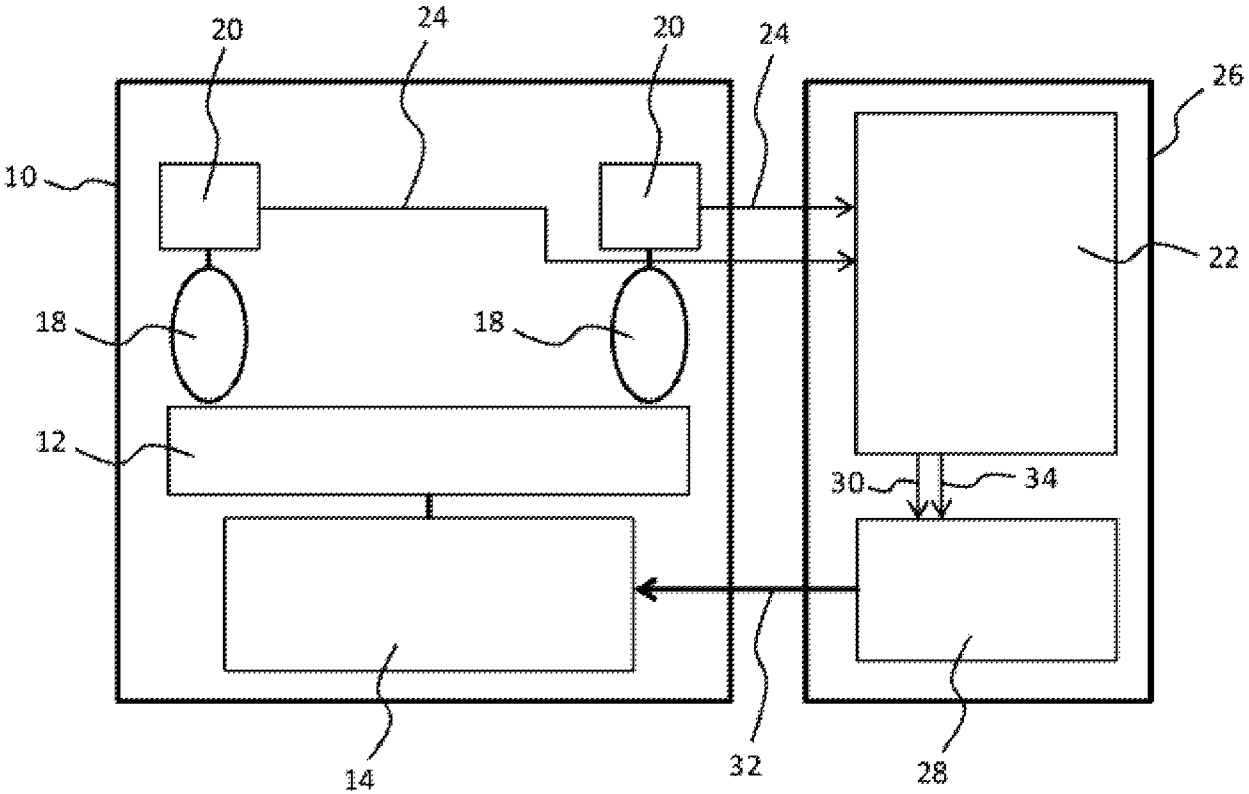
FIG. 1 illustrates a schematic representation of an embodiment of a rotary tablet press.
Figure 2:
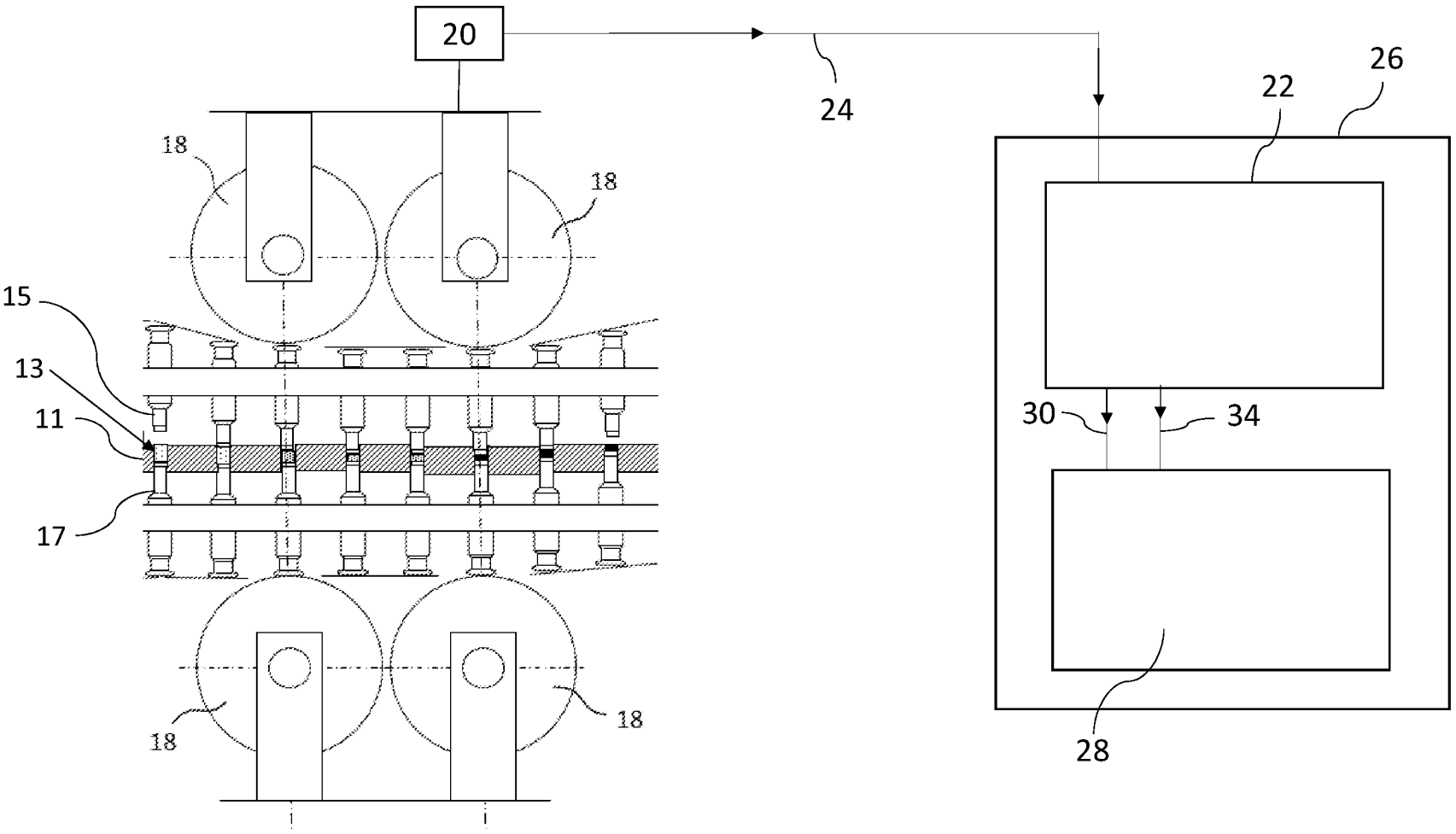
FIG. 2 illustrates a partial cross-sectional view of an embodiment of a rotary tablet press.
Figure 3:
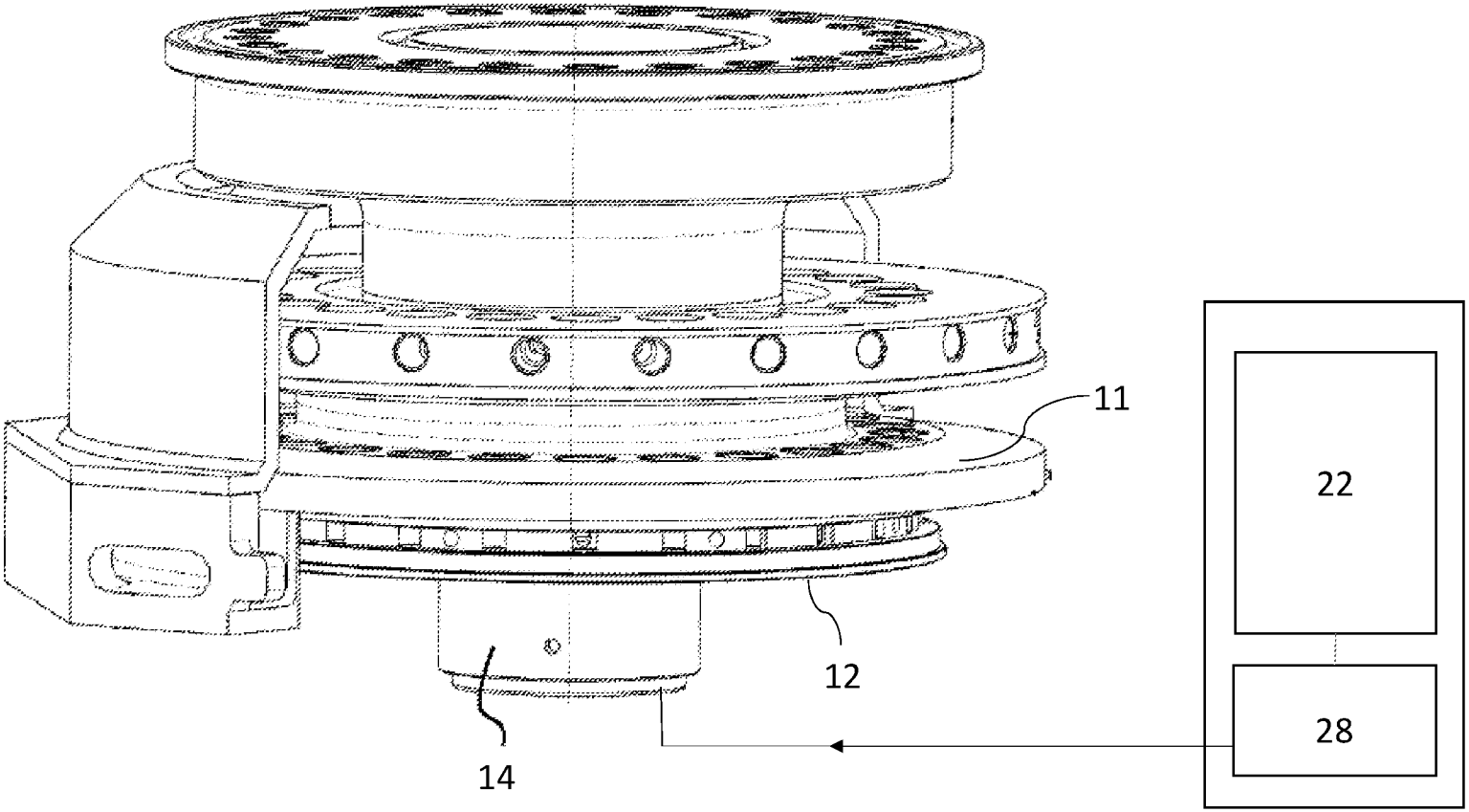
FIG. 3 illustrates a perspective view of an embodiment of a rotary tablet press without the punches pressing rollers, and pressing force sensors.

Referring to FIGS. 1-3, the rotary tablet press has a machine housing 10 in which a rotor 12 of the rotary tablet press can be driven by means of a rotary drive 14 that is also arranged within the machine housing 10. In a manner known per se, the rotor has a die plate 11 that rotates with the rotor and has a plurality of cavities 13, as well as a plurality of upper and lower punches 15. 17 that also rotate with the rotor and which are assigned in pairs to a cavity in the die plate to press filling material in the cavity into a pellet, in particular a tablet. The filling material is also pressed in a manner known per se in compression stations that comprise pressing rollers. In FIG. 1, only two top pressing rollers 18 are shown for reasons of illustration. Of course, bottom pressing rollers that are arranged opposite the top pressing rollers 18 are generally also provided and are shown in FIG. 2. Moreover, a pressing force sensor 20 such as a force transducer 20 is assigned to each pressing roller 18 in the shown example. The pressing force sensors 20 measure the pressing forces of the upper, or respectively lower punches that are guided through by the pressing rollers 18. This is accomplished in a manner known per se on the pressing rollers 18. Of course, corresponding pressing force sensors can also be assigned to other provided pressing rollers, in particular bottom pressing rollers.

The measured values of the pressing force sensors 20 are applied to a pilot control apparatus 22 as illustrated by the arrows 24. The pilot control apparatus 22 is arranged in a control housing 26 in which a frequency converter 28 forming a rotational speed governor is also arranged. In the shown example, the pilot control apparatus 22 dictates to the frequency converter 28 a target rotational speed value for the rotor rotational speed of the rotor 12 as illustrated by the arrow 30. The frequency converter 28 also receives the actual rotor rotational speed of the rotor 12 as a comparative measured value. From a comparison of the actual rotor rotational speed with the target rotational speed value, the frequency converter 28 determines a target torque value in the shown example for the frequency converter 28 to drive the rotary drive 14, as illustrated by the arrow 32, in order to adapt the actual rotor rotational speed to the target rotational speed value.

Based on the pressing force values provided by the pressing force sensors 20, the pilot control apparatus 22 determines an additional target torque as a pilot control in order to compensate in advance the load torque to be anticipated during a rotation of the rotor 12 due to the interaction between the upper and lower punches and the pressing rollers 18. The additional target torque is also provided to the frequency converter 28 by the pilot control apparatus 22 as illustrated in the FIGURE by the arrow 34. The frequency converter 28 adds this additional target torque to the target torque that it determined for the rotational speed control. The rotational drive 14 is therefore driven based on the target torque value determined by the frequency converter 28 during the control of the rotational speed, and the additional target torque provided by the pilot control apparatus 22. In this manner, a constant rotor rotational speed can be ensured even at low rotational speeds of the rotor 12.

In the portrayed example, the explained pilot control, in particular the determination of the additional target torque, only becomes active as of a threshold of, e.g., less than 30 RPM, preferably less than 20 RPM of the rotor 12. Below this threshold, the additional target torque is then permanently determined during the operation of the rotary tablet press by the pilot control apparatus 22. In particular, an additional target torque profile thereby results for the respective rotation of the rotor 12 that is correspondingly also taken into consideration during the rotational speed control which also runs permanently.

REFERENCE NUMBER LIST

Machine housing
Rotor
Rotary drive
Pressing rollers
Pressing force sensors
Pilot control apparatus
Arrow
Control housing
Frequency converter
Arrow
Arrow
Arrow

The invention claimed is:

1. A method for controlling rotor rotational speed of a rotor of a rotary tablet press, the method comprising:

rotating the rotor with a rotary drive;

rotating a die plate with the rotor, the die plate comprising a plurality of cavities and a plurality of upper and lower punches;

assigning the plurality of upper and lower punches in pairs to one of the plurality of cavities in the die plate for pressing a filling material in the one of the plurality of cavities into a pellet;

providing top and bottom pressing rollers configured to exert a pressing force upon contacting the plurality of upper and lower punches;

driving the rotary drive via a rotational speed governor configured to compare a measured rotor rotational speed with a target rotational speed value;

determining, using a pilot control apparatus, an additional target torque for driving the rotary drive based on the pressing force of at least one of the plurality of upper and lower punches;

preemptively applying the additional target torque before contact between the plurality of upper and lower punches with the upper and lower pressing rollers to maintain a constant rotational speed of the rotary drive upon contact between the upper and lower punches and the top and bottom pressing rollers; and controlling a rotational speed of the rotary drive after the upper and lower punches cease contact with the top and bottom pressing rollers such that the rotational speed does not increase above the target rotational speed value.

2. The method according to claim 1, further comprising determining the additional target torque during at least one complete rotation of the rotor.

3. The method according to claim 1, further comprising driving the rotary drive using a frequency converter as the rotational speed governor.

4. The method according to claim 3, further comprising:

receiving the target rotational speed value as a first input variable and the additional target torque as a second input variable; and driving the rotary drive based on the target rotational speed value and the additional target torque.

5. The method according to claim 1, further comprising measuring the pressing force by at least one pressing force sensor that is arranged on at least one of the top and bottom pressing roller of the rotary tablet press that is configured to press the upper and lower punches to press the filling material into the cavities.

6. The method according to claim 1, further comprising, indirectly measuring the pressing force using a determination of torque of the rotary drive.

7. The method according to claim 1, further comprising rotating the rotor at a rotational speed that is less than 30 RPM.

8. A rotary tablet press comprising:

a rotor comprising a rotary drive configured to rotate the rotor;

a die plate that rotates with the rotor and comprises a plurality of cavities;

a plurality of upper and lower punches and upper and lower pressing rollers, Wherein the plurality of upper and lower punches are assigned in pairs to one of the plurality of cavities in the die plate and are configured to press filling material in the cavity into a pellet;

a rotational speed governor that is configured to drive the rotary drive of the rotor by comparing a measured rotor rotational speed with a target rotational speed value; and a pilot control apparatus configured to, measure pressure values for at least one of the plurality of upper punches and the plurality of lower punches during a pressing of filling material into at least one of the plurality of cavities, determine an anticipated load torque for the rotary drive when passing through the upper and lower pressing rollers, provide the anticipated load torque to the rotational speed governor before initial contact between the plurality of upper and lower punches with the upper and lower pressing rollers, wherein the rotational speed governor is configured to apply the anticipated load torque and a target torque needed to achieve a target rotational speed so that a rotational speed of the rotary drive does not drop upon the initial contact between the plurality of upper and lower punches and the upper and lower pressing rollers, wherein the rotational speed of the rotary drive does not increase beyond the target rotational speed when the upper and lower punches leave the upper and lower pressing rollers.

9. The rotary tablet press according to claim 8, wherein the pilot control apparatus is configured to determine the anticipated load torque during at least one complete rotation of the rotor.

10. The rotary tablet press according to claim 8, wherein the rotational speed governor is a frequency converter configured to drive the rotary drive.

11. The rotary tablet press according to claim 10, wherein a target rotational speed value is applied to the frequency converter as a first input variable and the anticipated load torque is applied as a second input variable to the frequency converter, wherein the frequency converter is configured to drive the rotary drive based on the target rotational speed value and the anticipated load torque.

12. The rotary tablet press according to claim 11, further comprising at least one pressing force sensor configured to determine a pressing force, the at least one pressing force sensor is arranged on at least one of the upper and lower pressing rollers of the rotary tablet press that presses at least one of the upper and lower punches to press the filling material into the plurality of cavities.

13. The rotary tablet press according to claim 8, wherein the pilot control apparatus is configured to only become active when the rotational speed is less than 30 RPM.

* * * * *